United States Patent [19]

Gartland, Jr.

[11] Patent Number: 4,582,387

[45] Date of Patent: Apr. 15, 1986

[54] ELECTRICAL CONNECTOR WITH BLADE SUPPORTING WIRE CLAMP

[75] Inventor: Albert J. Gartland, Jr., Trumbull, Conn.

[73] Assignee: Harvey Hubbell Incorporated, Orange, Conn.

[21] Appl. No.: 672,138

[22] Filed: Nov. 16, 1984

[51] Int. Cl.[4] ..... H01R 13/40

[52] U.S. Cl. ..... 339/196 R; 339/246; 339/263 R

[58] Field of Search ..... 339/95 R, 246, 263 R, 339/191 R, 191 A, 191 M, 192 R, 195 R, 195 A, 195 M, 196 R, 196 A, 196 M

[56] References Cited

U.S. PATENT DOCUMENTS

| | | | |
|---|---|---|---|
| 3,023,395 | 2/1962 | Hubbell et al. | 339/263 |
| 3,050,706 | 8/1962 | Kitscha | 339/246 |
| 3,335,395 | 8/1967 | Smith | 339/196 M |
| 3,398,393 | 8/1968 | Cochrum | 339/246 |
| 3,605,059 | 9/1971 | Lipinski et al. | 339/195 R |
| 3,718,890 | 2/1973 | Sheldon | 339/196 A |
| 3,823,381 | 7/1974 | Maloof | 339/263 R |

*Primary Examiner*—John McQuade

*Attorney, Agent, or Firm*—Jerry M. Presson; Mark S. Bicks

[57] ABSTRACT

An electrical connector includes a housing and an electrical contact resiliently coupled to the housing with a blade end extending exteriorly of the housing and a wire connection end extending into an inner cavity of the housing. An externally threaded screw is rotatably coupled to the contact connection end, but is restrained against axial movement. A wire clamp threadedly engages the screw and is movable toward an away from the contact connection end. The wire clamp includes a center portion and lateral portions on its opposite sides, with the center portion having extensions that project beyond the lateral portions. Upon slight movement of the contact into the housing, the wire clamp will be placed in compression between the housing and the contact to limit retraction of the contact.

13 Claims, 9 Drawing Figures

ELECTRICAL CONNECTOR WITH BLADE SUPPORTING WIRE CLAMP

FIELD OF THE INVENTION

The present invention relates to an electrical connector comprising a housing, an electrical contact having one end extending into an inner cavity within the housing and a moveable wire clamp movably mounted within the housing cavity for mechanically and electrically coupling a wire to the inner end of the contact, and to the wire clamp for this type of connector. More specifically, the present invention relates to a wire attaching arrangement within a housing cavity having reduced clearance about the wire clamp such that a mechanical load placed on the contact places the wire clamp in compression between the contact and the housing preventing retraction of the contact into the housing.

BACKGROUND OF THE INVENTION

Conventional electrical connectors include a housing formed of a blade holder and a retainer attached by at least one fastener. A blade contact is resiliently coupled to the blade holder and extends through a contact opening in the blade holder such that its blade end extends exteriorly of the housing. A wire connection end of the contact is located in an inner cavity formed between the blade holder and retainer.

An externally threaded screw is rotatably coupled to the wire connection end of the blade contact, and is restrained against axial movement by the retainer and the contact. A wire clamp threadedly mounted on the screw moves toward and away from the contact connection end upon rotation of the screw.

A relatively light resilient connection is provided between the blade holder of the housing and the blade contact to facilitate insertion of the contact in the blade holder. The resilient connection is in the form of a snap connection formed by merely inserting the blade within the opening. Ease of insertion and positive locking of the blade contact in the blade holder is necessary for mass production of the electrical connector.

Recent federal specifications require that the distance the blade contact extends from the face of the electrical connector plug must be maintained, even after a high mechanical load is applied to reduce that distance, i.e., tending to push the blade contact back into the housing. The form of the blade contact is fixed by N.E.M.A. standards, while the wire termination arrangement is determined primarily by U.L. requirements for "dead-front" construction.

The metal contacts for the connectors are made from ductile alloys with insufficient rigidity to withstand the high mechanical loads required by the specifications, without an unacceptable degree of deformation. Increasing the rigidity of the resilient connection between the blade contact and the blade holder adversely affects the manufacture of the electrical connector by making it more difficult to insert the blade contact within the blade holder. Thus, an electrical connector is needed wherein the blade contact and its connection to the blade holder are substantially unchanged, while providing sufficient rigidity to the device to permit the connector to withstand the application of high mechanical loads on the blade contact in a direction towards its housing.

SUMMARY OF THE INVENTIONS

An object of the present invention is to provide an electrical connector and a wire clamp for an electrical connector which can withstand the application of relatively large mechanical loads on the blade contact in a direction toward the housing without the blade being retracted into the housing beyond a predetermined distance.

Another object of the present invention is to provide an electrical connector and a wire clamp for an electrical connector which is simple and inexpensive to manufacture and use.

A further object of the present invention is to provide an electrical connector and a wire clamp for an electrical connector which is of rugged construction and satisfies the appropriate standards and specifications.

The foregoing objects are obtained by an electrical connector comprising a housing of insulating material with an inner chamber, an electrical contact coupled to the housing and mounted in its contact opening, a wire attachment mounted on the inner end of the contact within the housing cavity, and a spacer. The wire attachment electrically and mechanically couples a wire to the inner end of the contact and includes an externally threaded screw and a wire clamp. The screw is rotatably mounted in the inner end of the contact and is restrained against axial movement. The wire clamp threadedly engages the screw and is moveable toward and away from the contact inner end upon rotation of the screw. The spacer is associated with the wire attachment and reduces clearance about the wire clamp for placing the wire clamp in compression between the housing and contact upon application of an inwardly directed force on the contact.

The objects of the present invention are also provided by a wire clamp having a center portion and first and second lateral portions on opposite sides of the center portion. The center portion has an internally threaded bore. The lateral portions have cutouts on their opposite ends for engaging wire. Extensions project from the opposite ends of the center portion between and beyond the cutouts.

By forming the electrical connector in this manner, a relatively small clearance is provided for the wire clamp between the contact and the housing. This clearance is necessary to permit free sliding motion of the wire clamp during attachment of a wire. Upon application of an inwardly directed force on the contact, the wire clamp is placed in compression between the contact and the housing limiting movement of the blade into the housing and maintaining adequate extension of the contact from the housing.

The spacer arrangement is particularly advantageous when the wire clamp has extensions on its center portion which project between and beyond the cutouts on lateral portions of the wire clamp. This enables the wire clamp to positively grip the wire, while reinforcing the resilient mounting of the contact in the housing without increasing the cost or difficulty of making and using the connector.

Other objects, advantages and salient features of the present invention will be become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF PREFERRED EMBODIMENTS

Figure 1:
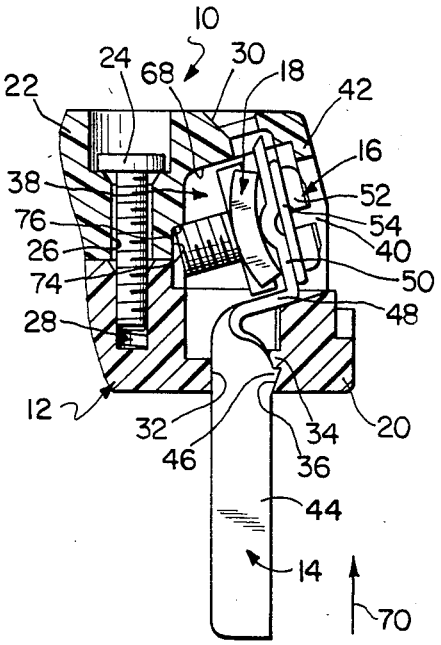
FIG. 1 is a partial, side-elevational view in section of an electrical connector according to a first embodiment of the present invention.
Figure 2:
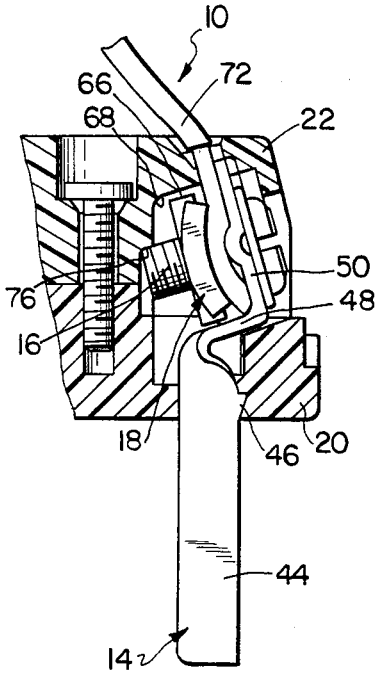
FIG. 2 is a partial, side-elevational view in section of the electrical connector of FIG. 1 with a wire attached.
Figure 3:
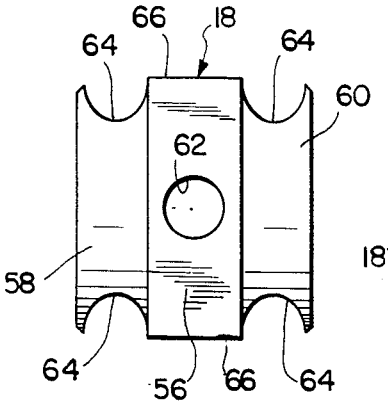
FIGS. 3, 4 and 5 are front, side and back elevational views, respectively, of the wire clamp for the electrical connector of FIG. 1.
Figure 4:
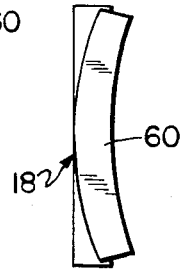
Figure 5:
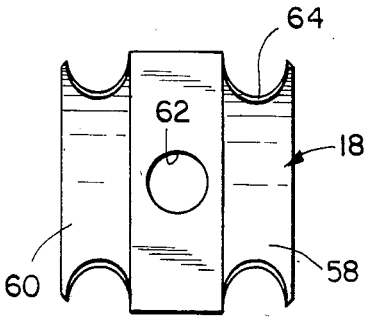
Figure 6:
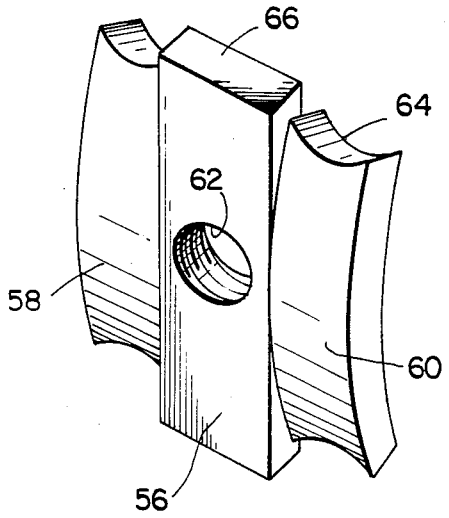
FIG. 6 is an enlarged prospective view of the wire clamp of FIGS. 3–5.

Referring initially to FIGS. 1 and 2, an electrical connector 10 according to the present invention, includes a housing 12 and an electrical contact 14 mounted in and extending exteriorly of the housing. An externally threaded screw 16 and a wire clamp 18 coupled to the screw electrically and mechanically attach a wire to an inner end of blade contact 14. The arrangement of wire clamp 18 between blade 14 and housing 12 reduces clearance about the wire clamp and places the wire clamp in compression between the housing and the contact upon applying an inwardly directed force on the contact, i.e., a force tending to push the contact into the housing.

Housing 12 is formed of insulating material, and comprises a blade holder 20 and a retainer 22. The blade holder and retainer are attached by at least one externally threaded fastener 24 passing through a bore 26 in retainer 22 and threadedly engaging an internally threaded bore 28 in blade holder 20. Retainer 22 has a tapered wire receiving opening 30. Blade holder 20 has a contact receiving opening 32 with a shoulder 34 and a recess 36.

The surface of retainer 22 facing blade 20 is recessed to define an inner cavity 38 in the housing. Access to inner cavity 38 is provided by an opening 40 in retainer 22, which opening is defined by a flange 42 extending into opening 40.

The contact blade 14 comprises a blade portion 44 extending exteriorly of housing 12, and having a laterally projecting barb 46 received in recess 36 and engaging shoulder 34 to resiliently retain and couple the contact to blade holder 20. The resiliency of the connection between contact 14 and blade holder 20 is provided by the inherent resiliency of the metal used to form contact 14.

Above blade portion 44, contact 14 has a generally laterally extending base member 48 and a generally axially extending member or binding plate 50 extending upwardly from base member 48 from the base member end remote from blade portion 44. Members 48 and 50 are located within inner cavity 38 of housing 12.

Screw 16 is rotatably mounted within a bore in member 50 such that the screw may rotate freely about its longitudinal axis, while coupled to contact 14. The screw has a head 52 with a flange 54. Head 52 has a slot for receiving a screwdriver to facilitate turning of the screw, which screwdriver passes through opening 40. Flange 54 extends laterally in a direction perpendicular to the screw longitudinal axis such that its dimensions in this direction are larger than the corresponding dimensions of opening 40 as defined by housing flange 42. Additionally, the flange lateral dimensions are greater than the opening receiving the screw in member 50. In this manner, the screw is retained against movement in the direction of its longitudinal axis by head 52 and flange 54 being captivated or retained between housing flange 42 and vertical member 50.

Referring now to FIGS. 3–6, wire clamp 18 comprises a center portion 56 and two lateral portions 58 and 60. The center portion is in the shape of a parallelepiped or a rectangular solid, and has a threaded bore 62 threadedly engaged on the screw threads of screw 16. As illustrated, particularly in FIG. 4, lateral portions 58 and 60 are arcuate and are somewhat shorter than the center portion. Additionally, the lateral portions project laterally beyond the thickness of center portion 56. The opposite ends of each lateral portion are provided with arcuate cutouts 64 with sharp edges for pentrating oxides or other coatings on the wires. This insures a positive and secure mechanical and electrical connection between contact 14 and the wire. The opposite ends 66 of center portion 56 form extensions of the center portion which project between and beyond cutouts 64.

The wire clamp can be formed of 0.062 or 0.080 CR steel with a No. 2 temper and No. 3 edge. Its hardness on the Rockwell B Scale is between 70 and 85. The length of the center portion is about 0.41 inch, while the length of the lateral portions is about 0.375 inch. The width of the center portion is about 0.16 inch, while the width of the entire wire clamp is about 0.385 inch.

Referring again to the FIGS. 1 and 2, wire clamp 18 is moveably mounted within cavity 38 between a wall 68 of retainer 22 defining cavity 38 and base member 48 of contact 14. Slight clearances are provided between each end 66 and wall 68 or base member 48 such that the wire clamp may move freely along the longitudinal axis of screw 16 upon rotation of the screw, while being restrained against rotation.

As illustrated in FIG. 2, a wire 72 is connected to contact 14, by inserting it within wire receiving opening 30 after wire clamp 18 has been adequately spaced from vertical member 50. Once the wire has been properly positioned between the wire clamp and the binding plate, screw 16 is rotated to move wire clamp 18 towards binding plate 50, gripping the wire with cutouts 64.

The extensions provided by ends 66 of wire clamp center portion 56 reduce the clearance to such an extent that only a slight deformation or movement is possible upon applying a load on blade portion 44 in a direction toward housing 12, i.e., in the direction of arrow 70. Slight movement of contact 14 in the direction of arrow 70 places the wire clamp center portion in compression between the housing and contact preventing further deformation or retraction of contact 14 into the housing. In this manner, the reduction in the length of the contact portion extending beyond the housing is limited, even upon subjecting the contact to high mechanical loads. Thus, application of the load on contact 14 in direction of arrow 70 permits the blade to be supported by retainer 22 through wire clamp 18.

The clearances between one center portion end 66 and wall 68 and between the other center portion end 66 and the base member 48 of contact 14 should be between about 0.005 inch and about 0.010 inch. Preferably, these clearances are about 0.005 inch to limit the inward movement of contact 14 to a distance of less than 0.020 inch. According to federal specifications, the maximum distance for inward movement is 0.031 inch.

The provision of the extensions on the center portion of the wire clamp to limit the clearance for the wire clamp in the electrical connector of the present invention reinforces the support for the clamp without adversely affecting the gripping action on wire 72 and without affecting the resilient connection between contact 14 and blade holder 20.

Alternatively, the wire clamp can be provided with only one end of its center portion which extends between and beyond the cutout 64.

To provide further support for the contact, a recess 74 can be formed in retainer 22 which opens into inner cavity 38. Recess 74 receives and end of screw 16 remote from head 52 and forms a shoulder 76 which can engage the screw end upon inward movement of blade contact 14. In this manner, additional support is provided reinforcing and preventing unwanted movement of contact 14 into the housing.

Figure 7:
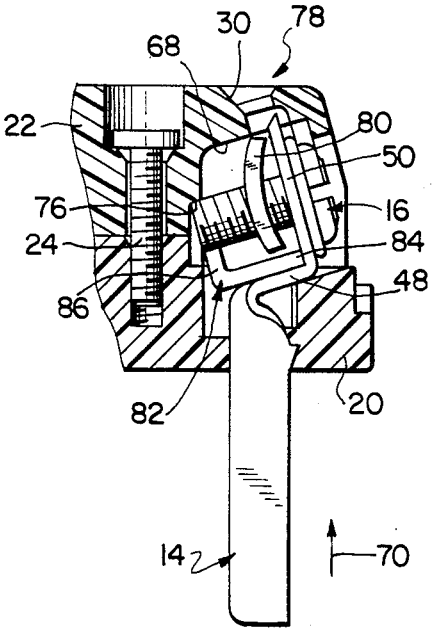
FIG. 7 is a partial, side-elevational view in section of an electrical connector according to a second embodiment of the present invention.
Figure 8:
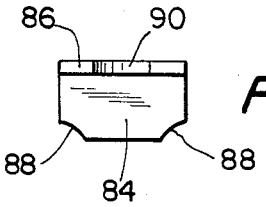
FIGS. 8 and 9 are top and side elevational views, respectively, of the spacer for the electrical connector of FIG. 7.
Figure 9:
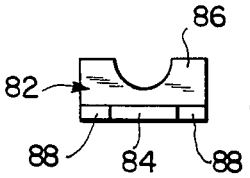

Referring to FIGS. 7–9, an electrical connector 78 according to a second embodiment of the present invention is illustrated. Features of electrical connector 78 which are substantially identical to corresponding features of electrical connector 10 are denoted with like reference numbers.

In electrical connector 78, wire clamp 80 comprises a curved plate without extensions. The clearance which would otherwise be provided between plate 80 and base member 48 of contact 14 is substantially filled by an L-shaped spacer 82.

Spacer 82 comprises a base leg 84 and a upstanding leg 86. Horizontal leg 84 overlies base member 48 and is fixedly attached to thereto, e.g., by welding. In this manner, only a slight clearance is provided between leg 84 and wire clamp 80. The free corners of base leg 84 are provided with cutouts 88 for receiving wire. Upstanding leg 86 has a central recess 90 which receives the free end of screw 16. The leg 84 extends generally parallel to the screw longitudinal axis, while leg 86 is substantially perpendicular to such axis.

Upon applying a load in the direction of arrow 70 on contact 14 of electrical connector 78, blade contact 14 will be displaced slightly placing wire clamp 80 and spacer leg 84 in compression between contact 14 and wall 68 of retainer 22. Additionally, forces will be then transmitted from leg 84 to leg 86, and through screw 16 to shoulder 76. In this manner, the load placed on contact 14 will be transmitted to retainer 22 to prevent unwanted retraction of blade contact 14 into the housing.

In each of the embodiments, sufficient reinforcement of the resilient connection between the contact and the blade holder is provided by reducing the clearance about the wire clamp or nut. By reducing this clearance, the mechanical load applied to the contact places the contact, wire clamp and housing in compression as a column to prevent excess retraction of the contact.

While various embodiments have been chosen to illustrate the invention, it will be understood by those skilled in the art the various changes and modifications can be made therein without departing from the scope of the invention as defined in the dependent claims.

What is claimed is:

1. An electrical connector, comprising:

a housing formed of insulating material, said housing having an inner chamber, a wire receiving opening and a contact opening extending from said inner chamber;

an electrical contact coupled to said housing and mounted in said contact opening, said contact having one end thereof located in said inner chamber;

wire attaching means, on said one end of said contact and located in said inner chamber, for electrically and mechanically coupling a wire to said one end, said wire attaching means including an externally threaded screw rotatably mounted in said one end of said contact and restrained against axial movement relative to said contact and including a wire clamp threadedly engaging said screw and movable toward and away from said one end of said contact upon rotation of said screw;

a projection extending from said wire clamp substantially perpendicular to said screw, reducing clearance about said wire clamp and placing said wire clamp in compression between said housing and said contact upon application of an inwardly directed force on said contact; and a recess in said housing extending coaxially relative to said screw and a shoulder facing said contact opening and defining a portion of said recess, said screw extending into said recess and having an end engaging said shoulder.

2. An electrical connector according to claim 1 wherein projections extend from opposite ends of said wire clamp substantially perpendicular to said screw.

3. An electrical connector according to claim 2 wherein said wire clamp comprises a center portion and first and second lateral portions on opposite sides of said center portion, said lateral portions having cutouts at ends thereof for engaging wire, said center portion having extensions between said cutouts forming said projections and extending axially beyond said lateral portions.

4. An electrical connector according to claim 3 wherein said first and second lateral portions are curved.

5. An electrical connector according to claim 3 wherein said cutouts have sharp edges.

6. An electrical connector according to claim 3 wherein said center portion is substantially a parallelepiped.

7. An electrical connector according to claim 3 wherein said center portion comprises an internally threaded bore receiving said screw.

8. An electrical connector according to claim 3 wherein said contact comprises resilient means engaging said housing and a generally laterally extending base member, said projections facing and being only slightly spaced from said base member and a wall of said housing defining said inner chamber.

9. An electrical connector according to claim 2 wherein said projections have ends spaced from said housing and said contact by distances between about 0.005 inch and about 0.010 inch.

10. An electrical connector, comprising:

a housing formed of insulating material, said housing having an inner chamber, a wire receiving opening and a contact opening extending from said inner chamber;

an electrical contact coupled to said housing and mounted in said contact opening, said contact having one end thereof located in said inner chamber and having a generally laterally extending base member;

wire attaching means, on said one end of said contact and located in said chamber, for electrically and mechanically coupling a wire to said one end, said wire attaching means including an externally threaded screw rotatably mounted in said one end of said contact and restrained against axial movement relative to said contact and including a wire clamp threadedly engaging said screw and movable toward and away from said one end of said contact upon rotation of said screw, said base member extending substantially parallel to said screw;

spacer means, associated with said wire attaching means, for reducing clearance about said wire clamp and for placing said wire clamp in compression between said housing and said contact upon application of an inwardly directed force on said contact, said spacer means including a spacer member fixed to said base member facing and only slightly spaced from said wire clamp, said spacer member being substantially L-shaped with first and second legs, said first leg overlying said base member and said second leg having an opening receiving said screw; and a recess in said housing extending coaxially relative to said screw and a shoulder facing said contact opening and defining a portion of said recess, said screw extending into said recess and having an end engaging said shoulder.

11. An electrical connector according to claim 10 wherein said first leg has free ends with wire receiving cutouts.

12. An electrical connector, comprising:

a housing including a blade holder end a retainer coupled by a fastener, said blade holder and said retainer defining an inner cavity, said retainer having a wire receiving opening, said blade holder having a contact opening;

a contact resiliently coupled to said blade holder in said contact opening, said contact having a blade end extending exteriorly of said housing and a wire connection end in said inner cavity;

an externally threaded screw rotatably coupled to said wire connection end, but restrained against axial movement relative to said wire connection end; and a wire clamp threadedly engaging said screw and movable toward and away from said wire connection end; and a recess in said housing extending coaxially relative to said screw and a shoulder facing said contact opening and defining a portion of said recess, said screw extending into said recess and having an end engaging said shoulder.

13. An electrical connector, comprising:

a housing formed of insulating material, said housing having an inner chamber, a wire receiving opening and a contact opening extending from said inner chamber;

an electrical contact coupled to said housing and mounted in said contact opening, said contact having one end thereof located in said inner chamber and having a generally laterally extending base member;

wire attaching means, on said one end of said contact and located in said chamber for electrically and mechanically coupling a wire to said one end, said wire attaching means including an externally threaded screw rotatably mounted in said one end of said contact and restrained against axial movement relative to said contact and including a wire clamp threadedly engaging said screw and movable toward and away from said one end of said contact upon rotation of said screw, said base member extending substantially parallel to said screw; and spacer means, associated with said wire attaching means, for reducing clearance about said wire clamp and for placing said wire clamp in compression between said housing and said contact upon application of an inwardly directed force on said contact, said spacer means including a spacer member fixed to said base member facing and only slightly spaced from said wire clamp, said spacer member being substantially L-shaped with first and second legs, said first leg overlying said base member, said second leg having an opening receiving said screw, said first leg having free ends with wire receiving cut outs.

* * * * *